US005762190A

United States Patent [19]

Leistner

[11] Patent Number: 5,762,190

[45] Date of Patent: Jun. 9, 1998

[54] TEE-NUT HOLDER STRIP

[75] Inventor: Martin Leistner, Toronto, Canada

[73] Assignee: Sigma Tool & Machine, Scarborough, Canada

[21] Appl. No.: 794,647

[22] Filed: Feb. 3, 1997

[51] Int. Cl.[6] ..... B65D 85/24

[52] U.S. Cl. ..... 206/347; 206/345; 206/343

[58] Field of Search ..... 206/338, 343, 206/345, 346, 347, 460

[56] References Cited

U.S. PATENT DOCUMENTS

| | | | |
|---|---|---|---|
| 2,784,405 | 3/1957 | Working . | |
| 3,927,459 | 12/1975 | Haytayan | 206/347 |
| 4,018,334 | 4/1977 | Lejdegard | 206/346 |
| 4,955,476 | 9/1990 | Nakata et al. | 206/343 |
| 5,214,843 | 6/1993 | Bromley et al. . | |
| 5,299,686 | 4/1994 | Bromley et al. . | |
| 5,327,645 | 7/1994 | Bromley et al. . | |
| 5,522,687 | 6/1996 | Chen | 206/347 |

*Primary Examiner*—David T. Fidei

[57] ABSTRACT

A tee-nut holder strip of breakable material, and a plurality of tee-nuts having threaded sleeves and flanges, and spikes formed from portions of the flanges and having a strip defining a plurality of precisely spaced apart holes formed axially along the central axis of the strip for receiving the sleeves of the tee-nuts, the holes being undersized relative to the sleeves and displacement of material by the sleeves causing a wedging grip on the sleeves and, strip material located around the holes and the tee-nuts having their spikes penetrating through the material around the holes, thereby holding the tee-nuts in a predetermined precisely spaced apart relationship in the strip of material, the material being breakable between the tee-nuts, to permit punching in of individual tee-nuts one at a time, into a workpiece.

8 Claims, 2 Drawing Sheets

TEE-NUT HOLDER STRIP

FIELD OF THE INVENTION

The invention relates to tee-nuts, which are sheet metal fasteners having a threaded barrel or sleeve and a flange, and in particular, to tee-nuts formed into a strip by a holder, to facilitate feeding of the tee-nuts into a tee-nut setting machine.

BACKGROUND OF THE INVENTION

Tee-nuts are a well known form of fastener, for securing metal fastenings in wood. Typically they are used in wooden furniture for securing components of the furniture together or for securing leg or arm assemblies to the furniture. Such tee-nuts comprise a cylindrical barrel or sleeve, at least a portion of which is threaded internally, and a flange at one end. Spikes are formed out of the flange and extend more or less parallel to the barrel. A hole is drilled in the workpiece and the barrel of the tee-nut is driven into the hole. The spikes enter the wood around the hole and hold the tee-nut in position. The flange prevents overdriving of the tee-nut.

Such tee-nuts are economical to make and are popular, as a means of assembling furniture components in particular, although they may have many other uses.

Tee-nut setting machines are available capable of automatically driving tee-nuts, which operate at a high rate of speed, limited only by the ability of the operator to move the wooden workpiece and line-up the next open hole in the wooden workpiece to drive in the next tee-nut.

Most of such machines incorporate a feeder bowl of substantial size for receiving a large quantity of loose tee-nuts. The bowl has a vibrator which causes the tee-nuts to travel from the bowl, down a slide one at a time, until they reach the driving in station. This process has worked more or less satisfactorily for many years. Occasionally, the tee-nuts may become jammed in the bowl. More often however, the tee-nuts become jammed in the slide and cause misfeeding. This interferes with the rhythm and speed of the operator of the machine and causes significant down time. Also, the Tee-nuts usually have small fringe portions, caused by the stamping operation. These fringe portions abrade the slide, a potential cause for further misfeeding.

A greatly improved form of tee-nut setting machine and tee-nut feed is disclosed in U.S. Pat. No. 5,214,843, title; Apparatus for Applying Tee-nut Fasteners to Workpieces, dated; Jun. 1, 1993, inventors; Keith G. Bromley and Walter H. Leistner, and U.S. Pat. No. 5,299,686, title; Rolled Strip of Tee-nut Fasteners for Tee-nut Fastener Setting Apparatus, dated; Apr. 5, 1995, inventors; Keith G. Bromley and Walter H. Leistner, and, U.S. Pat. No. 5,327,645, title; Tee-nut Fastener Feed Means for Tee-nut Fastener Setting Apparatus, dated Jul. 12, 1994, inventors; Keith G. Bromley and Walter H. Leistner.

In the apparatus disclosed in these patents the tee-nuts themselves are joined together by a flexible strip, or by flexible filaments, attached to the flanges of the tee-nut, and forming them into a strip. The strip of tee-nuts was then formed into a coil or roll and was then fed from the roll into a tee-nut setting machine. This system overcame many of the problems inherent in feeding loose tee-nuts from a hopper down a slide mechanism. There are however certain problems which have developed in association with this proposal, mainly from the viewpoint of forming the tee-nuts into a strip. Where a tape material was used it was simply adhesively bonded to the surface of the flange. The adhesive had to be sufficiently strong enough that it would bond immediately and securely to the metal surface of the tee-nut, and hold the tee-nuts on the strip until the tee-nuts were delivered to the setting portion of the machine. Such adhesives might prove to have a relatively short life such that for example the strip would not have an adequate shelf life, and tee-nuts would become separated from the strip.

During the process of manufacturing the tee-nuts, the cylindrical sleeve is punched out of a strip of sheet metal, and the flange with spikes or prongs is punched simultaneously out of the strip of sheet metal around the sleeve. For the purposes of fastening in a wooden workpiece this form of manufacture has proved satisfactory. However, the flange is frequently formed with a central depression, or well, around the cylindrical sleeve. When this occurs, the area of the flange available for bonding to the strip is substantially reduced, such that the tee-nuts may not always be securely bonded to the strip, because the flange does not have a flat level surface, of sufficient area for bonding.

Another difficulty is caused by the small fringe portions, produced in the stamping operation. These fringe portions lie on the same side as the tape material and may interfere with the bonding.

A further difficulty is caused by the fact that on the tee-nut setting machine, the plunger that drives the tee-nut into the wood workpiece has a central protrusion that fits into the cylindrical sleeve of the tee-nut and which accurately guides the tee-nut into the hole. This protrusion must pierce through the tape, in the type of strip described above.

As a result of these various difficulties, the flexible strip of tee-nuts produced with a tape material adhesively bonded to the surface of the flange is quite fragile and must be handled carefully. However in order for the strip of tee-nuts to be flexible, the tee-nuts on the strip must be evenly and precisely spaced apart on the strip. If the tee-nuts are not spaced evenly and precisely apart then the strip will be flexible only when the tape is bent back on itself, whereas when bending in the other direction, the tee-nuts will interfere with each other. With the adhesive tape on the upper surface of the flange it is difficult to maintain accurate and consistent spacing between the tee-nuts and as the tape is thin for reasons discussed previously, it is not sufficiently rigid to maintain the precise separation.

For all of these reasons it is desirable to provide a tee-nut strip which is economical and fast to produce, and which uses low-cost materials and assembly methods, and which provides secure and precise attachment for the tee-nuts.

BRIEF SUMMARY OF THE INVENTION

With a view to providing an improved tee-nut holder strip, the invention comprises a tee-nut strip of breakable material, and a plurality of Tee-nuts having threaded sleeves and flanges, and spikes formed from portions of said flanges and comprising, a plurality of spaced apart holes formed axially along the central axis of said strip and being of reduced cross-section relative to the sleeves, for receiving the sleeves of the tee-nuts and the material being displaced by the sleeves to provide a wedging grip on the sleeves and, strip material located around said holes and said tee-nuts having their spikes penetrating through said material around said holes, thereby holding said tee-nuts in a predetermined precisely spaced apart relationship in said strip of material, said material being breakable between said tee-nuts, to permit punching in of individual tee-nuts one at a time, into a workpiece.

The invention may also include a film of thermoplastic on the upper side of the strip for improved strength.

The provision of holes through the strip means that the upper ends of the sleeves are left open and unobstructed, and are more easily accessible to registration with the plunger on the insertion machine.

The invention may also include an adhesive layer on the upper side of the strip, so that it underlies the flanges of the tee-nuts, and makes an adhesive bond therewith.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
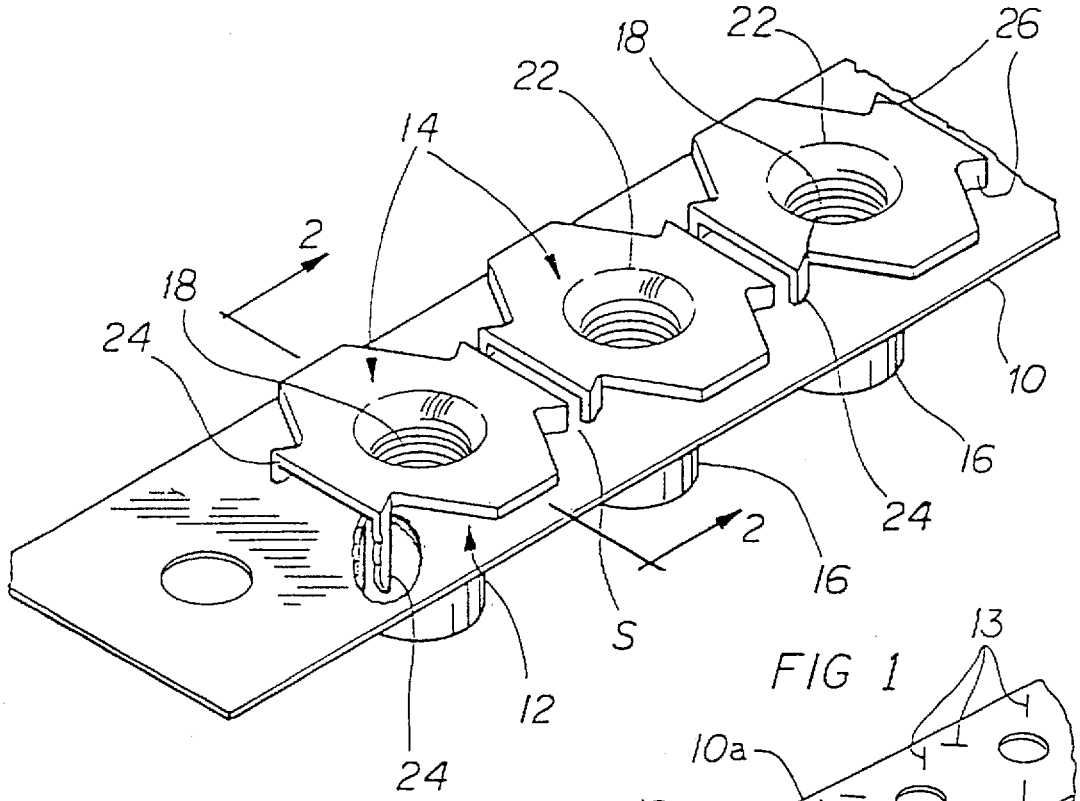
FIG. 1 is a perspective illustration of a tee-nut holder strip showing a strip with a plurality of tee-nuts in position with their cylindrical sleeves extending through holes in the strip and with their spikes penetrating and passing through the strip.
Figure 2:
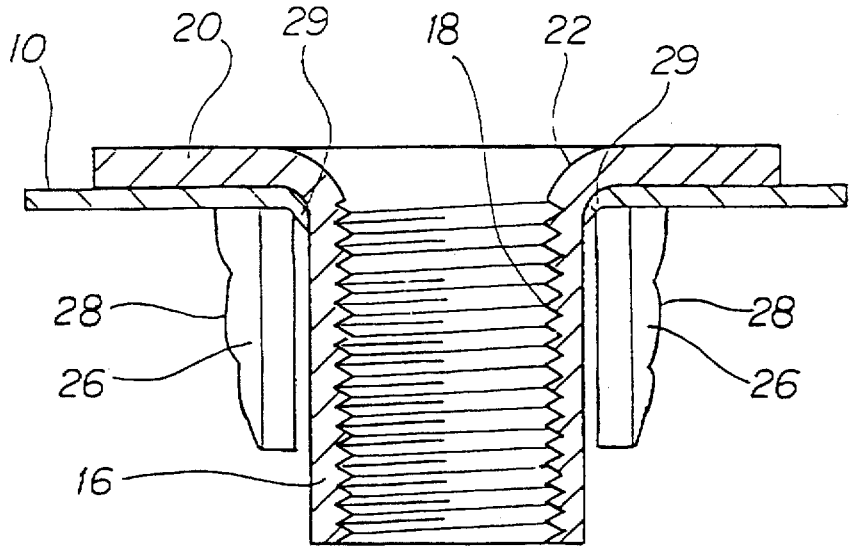
FIG. 2 is a greatly enlarged section along the line 2—2 of FIG. 1 showing a single tee-nut in position in the strip and showing displaced portions of the strip around the sleeve.

Referring first of all to FIGS. 1 and 2, it will be seen that the invention is illustrated here in the form of a strip 10 of tape material, formed with a plurality of holes 12 in precisely spaced apart relation.

Between the holes the strip of the tape is continuous for reasons to be described. The tee-nuts are indicated generally as 14. They comprise in a well-known manner, cylindrical sleeves 16, which are threaded on the interior, 10 as 18. Flanges 20 are formed on one end of the sleeves 14, and are usually shaped in a generally octagonal fashion as shown. However, numerous other shapes such as circular, rectangular, square, oval or the like may be used to suit the requirements of any particular customer. As will be noted, typically the flange 20 forms a shallow depression or concavity 22 around the entrance to the threads 18. Alongside free edges of the flanges 20, there are formed spikes or prongs 24 and 26. The spikes or prongs 24 are formed as a pair at one end of the tee-nut and the spikes or prongs 26 are formed as a pair at the other end of the tee-nut. Usually these spikes are arranged in pairs in this way so that they may ride in a tee-nut feed track, (not shown), with the sleeve, and the four spikes extending from a slot in the slide. The spikes or prongs are advantageously formed with serrations 28 to assist in providing a secure hold in a wooden work piece.

The tape 10 is made of paper of a sufficient strength and stiffness, or other suitable material. The holes 12 have a cross-section less than the cross-section of the tee-nut sleeves. The holes 12 are punched at precise spacings. The insertion of the sleeves displaces some material 29 around the holes. This provides a wedging grip of the material on the sleeves. When the sleeves 16 of the tee-nuts are inserted in the holes 12, the tee-nuts are located with their respective flanges slightly spaced apart as at S. This enables the tape to be flexed into a roll so as to facilitate feeding into a tee-nut setting machine (not shown). The prongs 24, 26 penetrate the tape 10, thus holding the tee-nuts more securely. The upper ends of the sleeves 16 are open, and unobstructed by the tape.

Figure 1A:
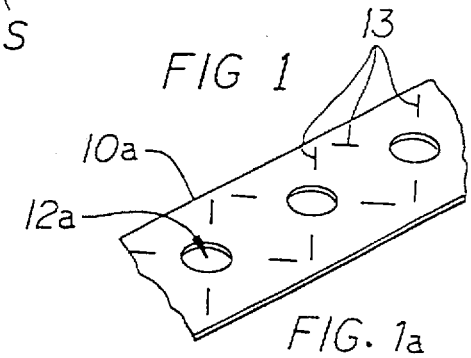
FIG. 1A is a perspective illustration of a modified form of holder strip, showing slits to receive the prongs or spikes.

In certain cases, a modified form of tape 10A (FIG. 1A) may be used. In this case, slits 13 may be formed radially around each of the holes 12A. The slits 13 will be available to receive the prongs or spikes which may be advantageous in some cases.

Figure 3:
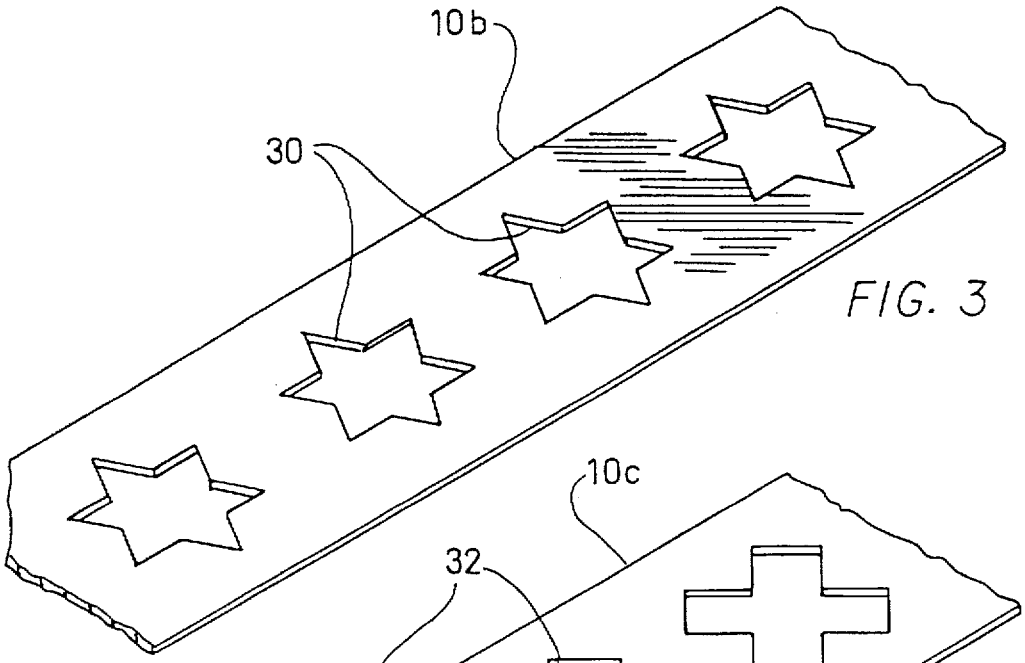
FIGS. 3, 4 and 5 are plan views of modified forms of strips.
Figure 4:
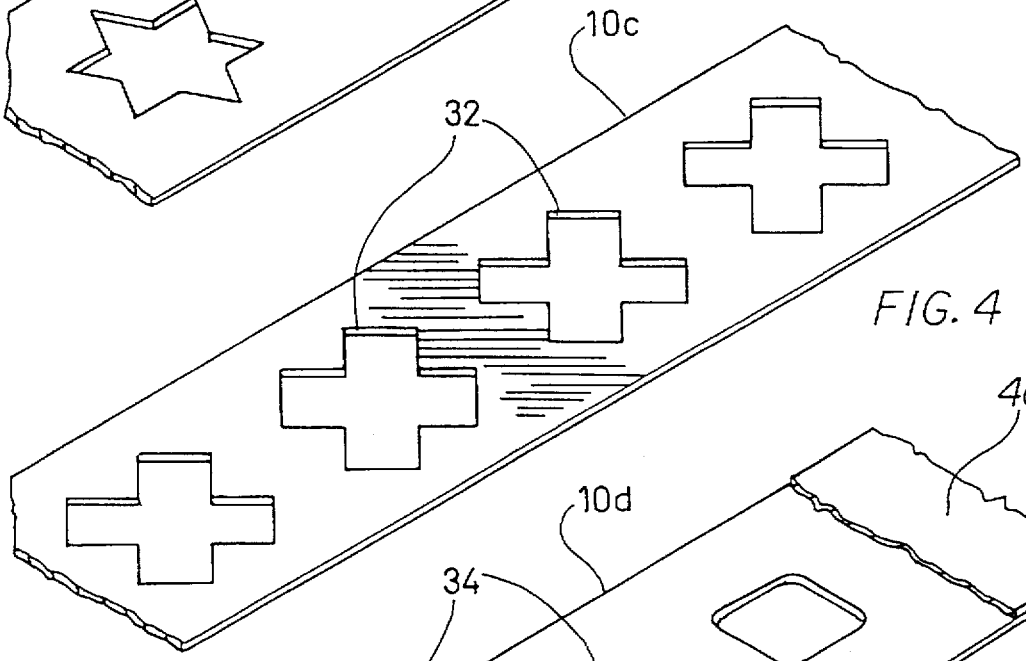
Figure 5:
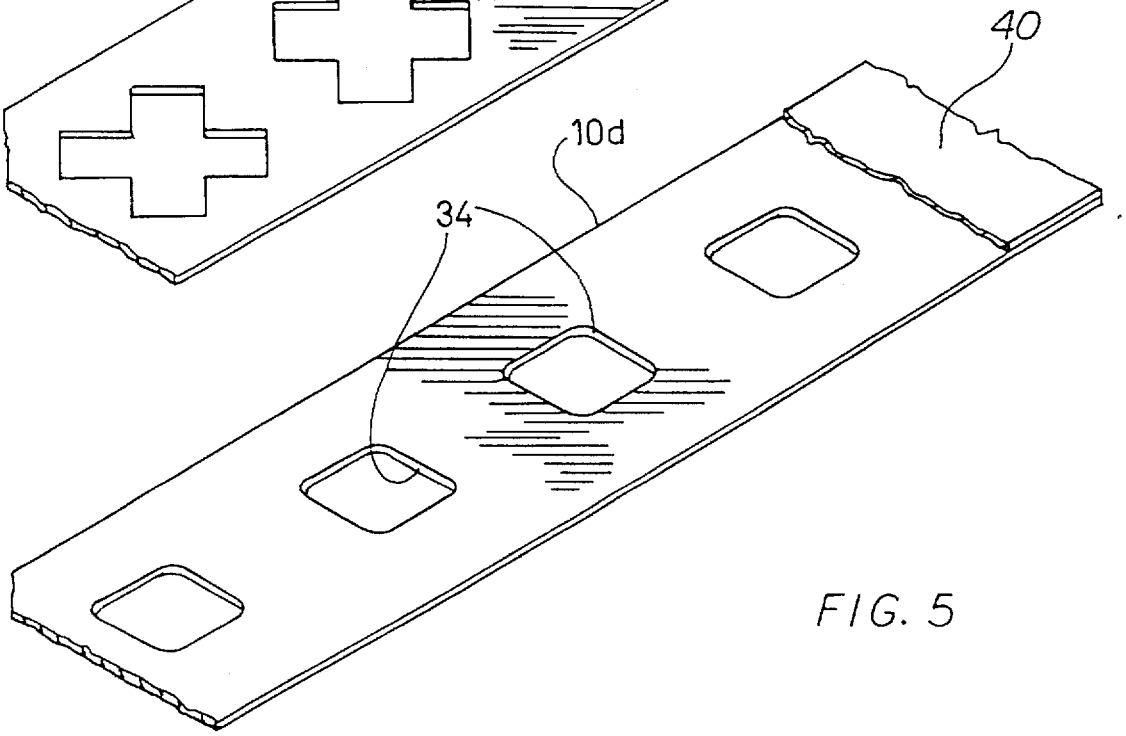

Referring now to FIGS. 3, 4 and 5, various alternate forms of strip 10 are shown.

In FIG. 3, a strip 10B has openings which are of generally star shape indicated 30. As the tee-nut sleeves are forced through such openings the prongs of the star will be bent and deflected and provide a wedging action to hold the tee-nut in position.

FIG. 4 shows a further modified strip 10C with an opening 32 generally in the form of a cross. Again, as the sleeve is forced through such opening the arms of the cross will be deflected and provide a wedging action against the sleeve.

In FIG. 5 the strip 10D has an opening 34 which is generally rectangular in shape, and of a smaller cross-sectional area than the size of the sleeves. As the sleeves are forced through such openings 34, the sides of the 10 openings will be deflected and bent, and will provide a wedging action to hold the sleeves in position.

The material preferable consists of paper stock of thickness of between about 0.008" to 0.012". A layer of thermoplastic 40 (FIG. 5) may be laminated to the strip if desired, up to about 0.005" thick, or adhesive material may be used.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A tee-nut holder strip of semi-stiff breakable material, and a plurality of tee-nuts having threaded sleeves having a transverse dimension D and having flanges, and spikes formed from portions of said flanges and comprising;

a strip of material defining a plurality of precisely spaced apart holes having a cross-section d less than dimension D and being formed axially along the central axis of said strip for receiving the sleeves of the tee-nuts;

tee-nuts having their sleeves received in said holes, portions of said strip material around said holes being displaced to thereby wedge said sleeves in said holes at precisely spaced apart intervals; and said spikes of said tee-nuts penetrating through said strip material around said holes, thereby holding said tee-nuts in a predetermined precisely spaced apart relationship in said strip of material, said material being breakable between said tee-nuts, to permit punching in of individual tee-nuts one at a time, into a workpiece.

2. A tee-nut holder strip as claimed in claim 1 including adhesive on an upper side of the strip, so that it underlies the flanges of the tee-nuts, and makes an adhesive bond therewith.

3. A tee-nut holder strip as claimed in claim 1 and including slits pre-punched in said material radially around each said hole to receive said spikes.

4. A tee-nut holder strip as claimed in claim 1 and wherein said holes in said strip are of generally irregular shape, whereby when said sleeves are forced through said holes they will deflect portions of said material around said holes, and provide a wedging, gripping action on said sleeves.

5. A tee-nut holder strip as claimed in claim 4 wherein said holes are of star shape.

6. A tee-nut holder strip as claimed in claim 4 wherein said holes are in the shape of a cross.

7. A tee-nut holder strip as claimed in claim 4 wherein said holes are of generally rectangular shape and are of a smaller cross-sectional area than said sleeves.

8. A tee-nut holder strip as claimed in claim 1 including a plastic laminate layer, on one side of said strip.

* * * * *